US005202663A

United States Patent [19]

Tomono et al.

[11] Patent Number: 5,202,663

[45] Date of Patent: Apr. 13, 1993

[54] SMALL SIZED ELECTROMAGNETIC RELAY

[75] Inventors: Noboru Tomono, Nagano; Takahiro Nakabayashi, Saku; Tomohima Ichikawa, Saku; Hisao Ozawa, Saku; Takeshi Shibusawa, Saku; Atsuto Kobayashi, Saku, all of Japan

[73] Assignee: Takamisawa Electric Co., Ltd., Tokyo, Japan

[21] Appl. No.: 801,209

[22] Filed: Dec. 2, 1991

[30] Foreign Application Priority Data

Feb. 27, 1991 [JP] Japan ..... 3-032842
Apr. 12, 1991 [JP] Japan ..... 3-80049
Aug. 5, 1991 [JP] Japan ..... 3-88576

[51] Int. Cl.[5] ..... H01H 51/22

[52] U.S. Cl. ..... 335/86; 335/78; 335/128

[58] Field of Search ..... 335/78-86, 335/124, 128, 135, 131

[56] References Cited

U.S. PATENT DOCUMENTS 4,618,842 10/1986 Nestlen .
4,958,137 9/1990 Schroeder ..... 335/128
5,027,094 6/1991 Yasuoka et al. ..... 335/78
5,038,123 8/1991 Brandon ..... 335/128

FOREIGN PATENT DOCUMENTS 60-249221 12/1985 Japan .

*Primary Examiner*—Lincoln Donovan
*Attorney, Agent, or Firm*—Armstrong, Westerman, Hattori, McLeland & Naughton

[57] ABSTRACT

In an electromagnetic relay, a position of an electromagnet assembly (X) having a core (4), a bobbin (1), a yoke (5), a hinge spring (6), and an armature (7) relative to a base block assembly (Y) having a base block (8) and a contact spring assembly (9, 10, 11) is adjusted and fixed.

7 Claims, 9 Drawing Sheets 12
10a
9a
11a
9
11
Y
4
1
2
A
3b
5
X'
X
X''
7
7a
6

SMALL SIZED ELECTROMAGNETIC RELAY

BACKGROUND OF THE INVENTION

1. Field of the Invention

The present invention relates to an electromagnetic relay used in an industrial apparatus, an automobile, and the like.

2. Description of the Related Art

In general, an electromagnetic relay is constructed by a core, a bobbin into which the core is inserted, a winding wound on the bobbin, a yoke fixed to an end of the core, an armature coupled via a hinge spring to the yoke, and coupled to the other end of the core, a movable contact, a stationary contact, a base block for adhering the contacts thereto, and the like. An electromagnetic assembly including the core, the bobbin, the winding, the yoke, the armature, and the like is located at a predetermined position within the base block, and a contact spring assembly including the movable contact and the stationary contact is also located at a predetermined position within the base block (see: JP-A-60-249221). In this case, after these elements are assembled, a relationship therebetween is determined to thereby obtain a load of the armature, and thus establish a sufficient contact pressure between the movable contact and the stationary contact in an active mode.

Nevertheless, in practice the dimensions, strength, and the like of the elements of the relay fluctuate, and therefore, a contact gap between the movable contact and the stationary contact and an armature load characteristic also fluctuate in accordance with the electromagnetic relay. As a result, the contact gap and the armature characteristic are designed by taking into consideration the fluctuations of each of the elements.

Therefore, in the above-mentioned prior art, since an absorption force (coercive force) of an electromagnet must be designed to satisfy a maximum armature load characteristic, the size of the electromagnet, i.e., the size of the relay, is increased, and as a result, a power dissipation must be increased to cope with the increased size of the relay.

SUMMARY OF THE INVENTION

Therefore, an object of the present invention is to provide an electromagnetic relay having a small size and a low power dissipation.

Therefore, in an electromagnetic relay according to the present invention, a position of an electromagnet assembly having a core, a bobbin, a yoke, a hinge spring, and an armature, relative to a base block assembly having a base block and a contact spring assembly, is adjusted and fixed. Namely, an adjustment of the relative position of the electromagnet assembly to the base block, i.e., an adjustment of the armature to the contact spring assembly, is carried out before the electromagnet assembly is fixed to the base block, thus absorbing any fluctuations of the dimension and strength of each element before the assembly thereof.

BRIEF DESCRIPTION OF THE DRAWINGS

The present invention will be more clearly understood from the description as set forth below, with reference to the accompanying drawings, wherein.

DESCRIPTION OF THE PREFERRED EMBODIMENTS

Figure 1:
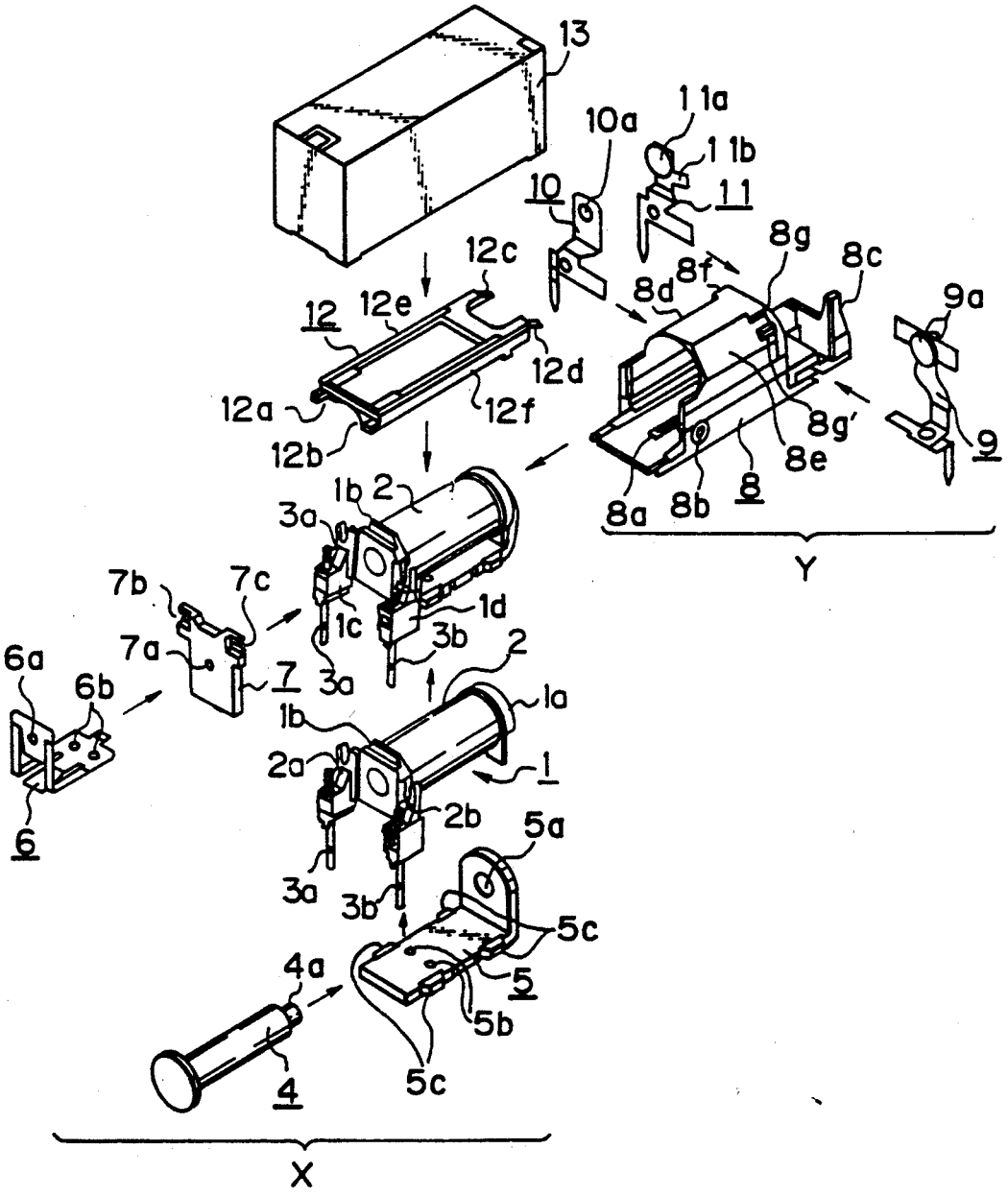
FIG. 1 is an exploded, perspective view illustrating an embodiment of the electromagnetic relay according to the present invention.
Figure 2:
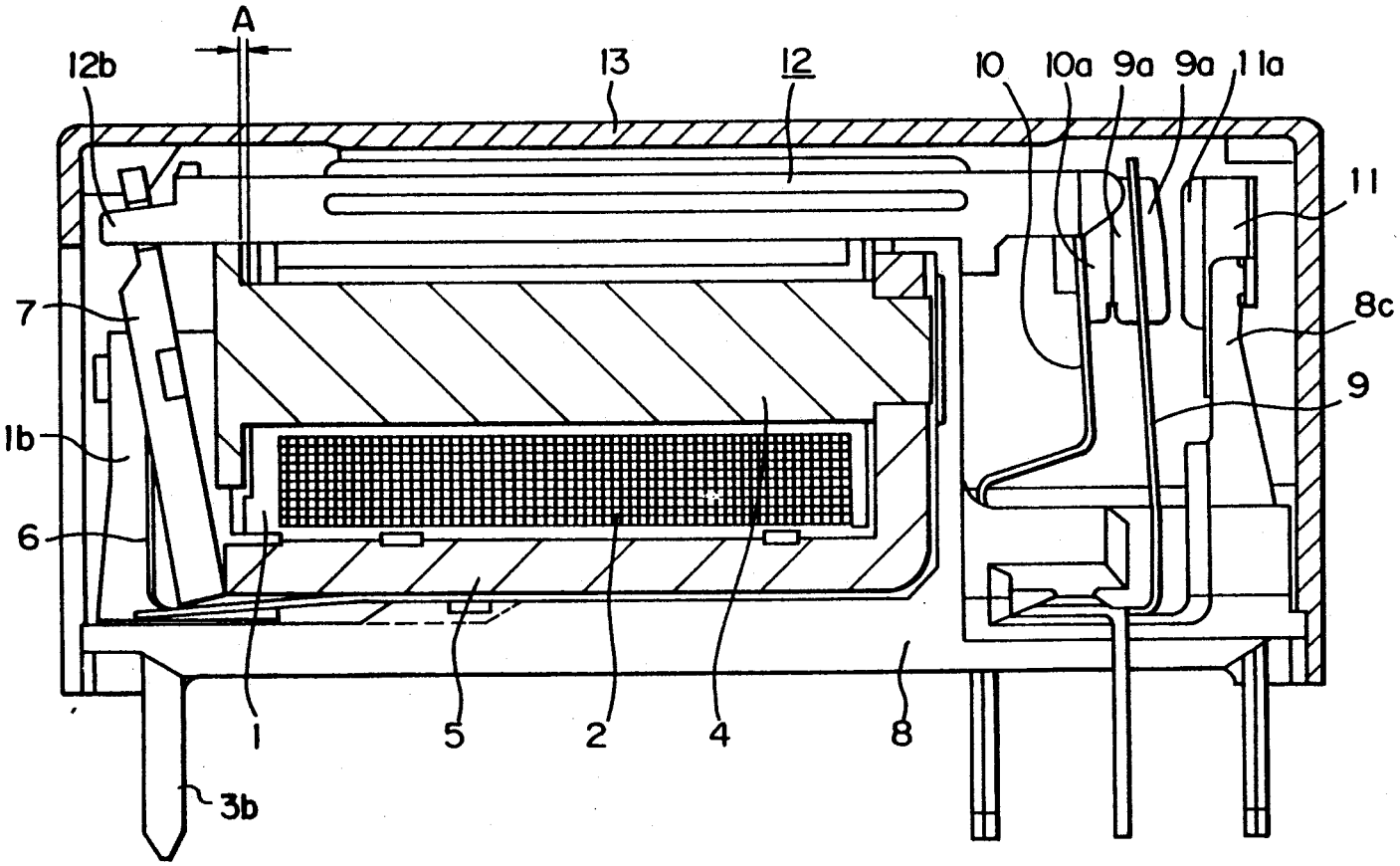
FIG. 2 is a longitudinal cross-sectional view of the assembled relay of FIG. 1.
Figure 3:
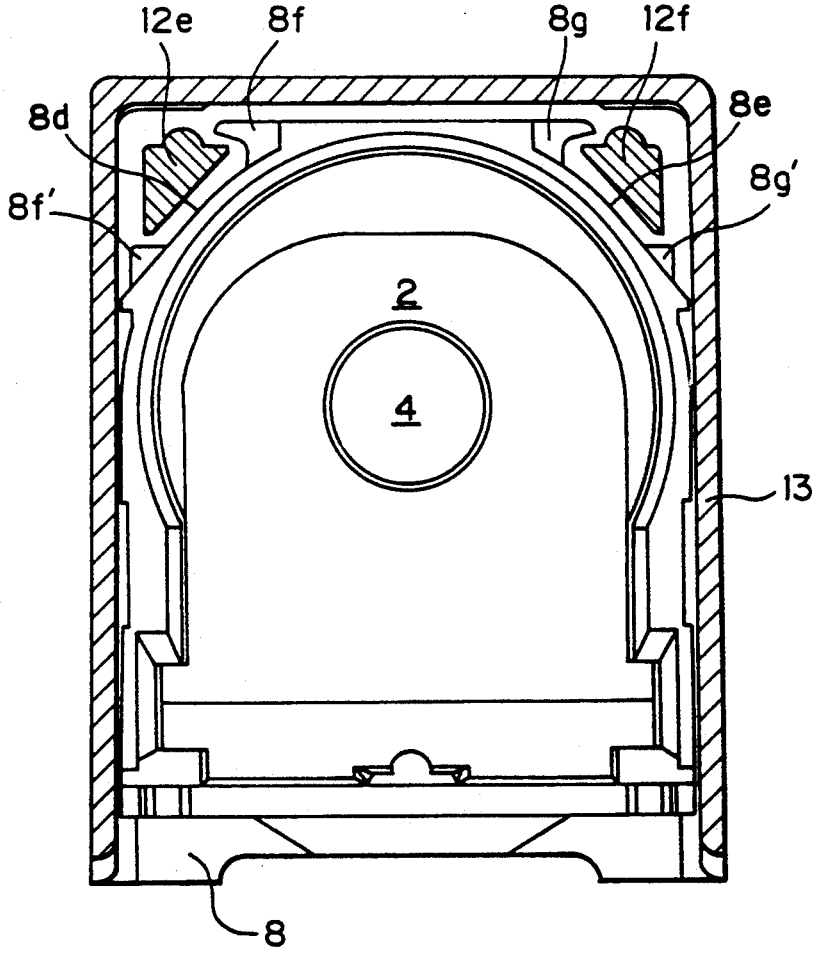
FIG. 3 is a transverse cross-sectional view of the assembled relay of FIG. 1.

In FIGS. 1, 2, and 3, which illustrate an embodiment of the present invention, reference X designates an electromagnet assembly, and Y designates a base block assembly. Further, reference numeral 1 designates a bobbin on which a winding 2 is wound.

The bobbin 1 has two collars 1*a* and 1*b*, and block-shaped portions 1*c* and 1*d* protruded from the collar 1*b*, and winding terminals 3*a* and 3*b* are inserted under pressure into the block-shaped portions 1*c* and 1*d*, and ends 2*a* and 2*b* of the winding 2 are twisted onto the tops of the winding terminals 3*a* and 3*b*.

Reference numeral 4 designates a core penetrating the center of the bobbin 1. Note, after an end 4*a* of the core 4 is inserted into a hole 5*a* of a yoke 5, this end 4*a* is caulked and fixed to the yoke 5.

Reference numeral 6 designates a hinge spring having a hole 6*a* into which a protrusion 7*a* of an armature 7 is inserted. The armature assembly is completed by caulking the protrusion 7*a*, and the electromagnet assembly X is completed by inserting protrusions 5*b* of the yoke 5 into holes 6*b* of the hinge spring 6.

The base block assembly Y is explained below.

A base block 8 includes an approximately cylindrical insulating barrier 8*a* having an opening through which the electromagnet assembly X is inserted. Also, a movable contact spring 9 having a contact 9*a* and stationary contact springs 10 and 11 having contacts 10*a* and 11*a* are inserted by molding into the base block 8. The stationary contact spring 11 has a fitting portion 11*b* retained at a predetermined position by a stopper 8*c* protruded from the base block 8, and thus the base block assembly Y is completed.

Reference numeral 12 designates a two-parallel-arm type card for transmitting a motion of the armature 7 to the movable contact spring 9. That is, the card 12 has hook portions 12*a* and 12*b* retained by notched portions 7*b* and 7*c* of the armature 7, protrusion portions 12*c* and 12*d* in contact with the movable contact spring 9, and two arm portions 12*e* and 12*f* linking the portions 12*a* and 12*b* and the portions 12*c* and 12*d*. The card 12 is made of, for example, plastic. When the armature 7 is rotated by the core 4, the card 12 is moved to the right in FIG. 2, and the movable contact spring 9 is operated so that the movable contact 9*a* is separated from the stationary contact 10*a* and comes into contact with the stationary contact 11*a*.

Also, reference numeral 13 designates a box for accommodating the body of the relay.

As illustrated in detail in FIG. 3, sloped portions 8*d* and 8*e* are provided on the base block 8 along the external periphery of the winding 2, to create spaces between the base block 8 and the cover 13 in which the arms 12*e* and 12*f* of the card 12 are located, whereby the size of the relay of FIG. 1 can be reduced. Further, protrusions 8*f* and 8*f'* and protrusions 8*g* and 8*g'* are provided at the sloped portions 8*d* and 8*e* of the base block 8, respectively, to thereby define the positions of the arms 12*e* and 12*f*. In this case, it is unnecessary for the arms 12*e* and 12*f* of the card 12 to be retained by the movable contact spring 9, as shown in FIG. 2.

An assembling of the relay of FIG. 1 is explained below.

Figure 4:
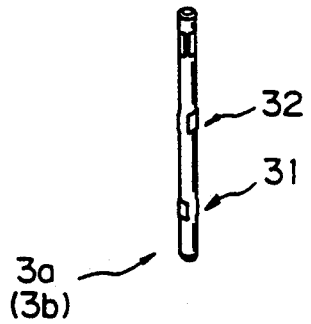
FIG. 4 is a perspective view of the winding terminal of FIG. 1.

First, as shown in FIG. 4, the winding terminal 3*a* (3*b*) is prepared. That is, two squeezes 31 and 32, which are arranged perpendicular to each other, are provided to increase the insertion strength of the winding terminal 3*a* (3*b*) into the bobbin 1. In this case, the squeeze 31 is used for provisionally fixing the winding terminal 3*a* (3*b*) to the bobbin 1, and the squeeze 32 is used for permanently fixing the winding terminal 3*a* (3*b*) to the bobbin 1.

Note that the squeezes 31 and 32 can be provided along the whole external periphery of the winding terminal 3*a* (3*b*), and in this case, the radius of the squeeze 32 is made larger than the squeeze 31.

Figure 5A:
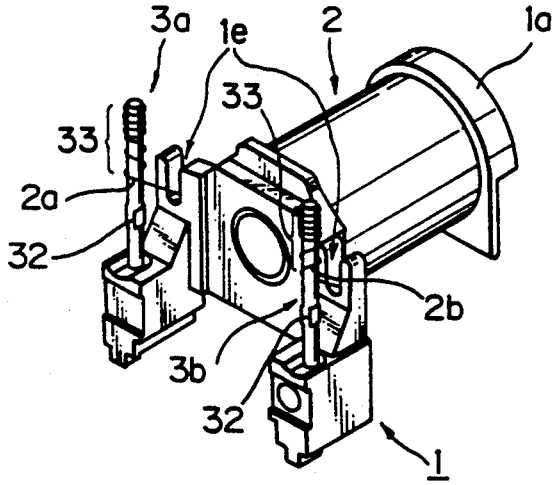
FIG. 5A is a perspective view showing a first assembled state of the relay of FIG. 1.
Figure 5B:
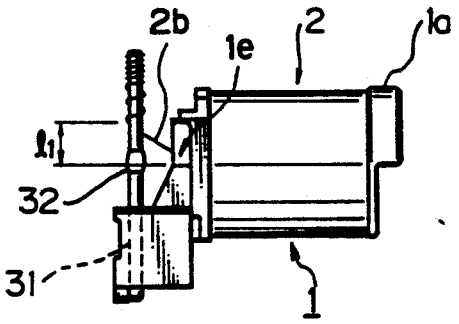
FIG. 5B is a side view of FIG. 5A.

Next, as shown in FIGS. 5A and 5B, which show a provisional fixing of the winding terminals 3*a* and 3*b* to the bobbin 1, the winding terminals 3*a* and 3*b* are inserted under pressure into the bobbin 1, and in this case, the insertion strength is retained by the squeeze 31. In this state, the winding 2 is wound on the bobbin 1, and ends 2*a* and 2*b*, which are extensions of the winding 2, are twisted by using the nozzle (not shown) on the tops 33 of the winding terminals 3*a* and 3*b*. In this case, it is easy to carry out a winding and twisting operation, due to the space surrounding the tops 33 of the winding terminals 3*a* and 3*b*.

Figure 6A:
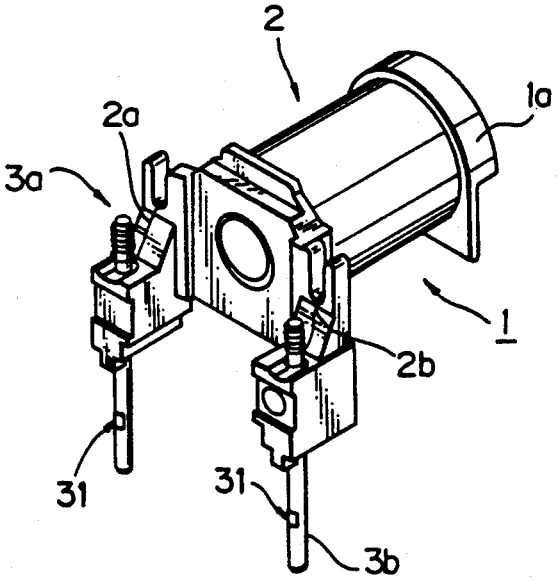
FIG. 6A is a perspective view showing a second assembled state of the relay of FIG. 1.
Figure 6B:
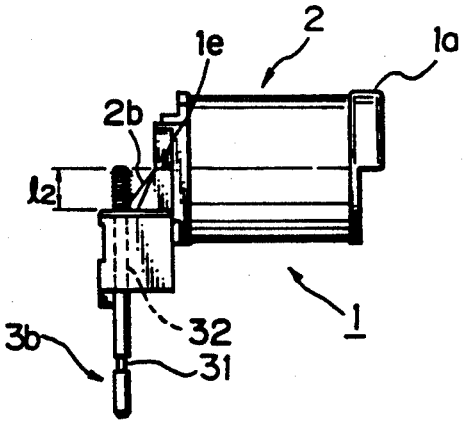
FIG. 6B is a side view of FIG. 6A.

Next, as shown in FIGS. 6A and 6B, which show a permanent fixing of the winding terminals 3*a* an 3*b* to the bobbin 1, the winding terminals 3*a* and 3*b* are further inserted under pressure into the bobbin 1, and as a result, the insertion strength is retained by the squeeze 32. Thus, it is easy to accommodate the winding block as shown in FIGS. 6A and 6B into the box 13, since the height of the winding block is small.

As shown in FIGS. 5A and 5B and FIGS. 6A and 6B, a distance $l_1$ between a winding groove le of the bobbin 1 and a twisting start point of the end 2*a* (2*b*) of the winding 2 at a provisional location (FIGS. 5A and 5B) is approximately the same as a distance $l_2$ between the winding groove le of the bobbin 1 and the twisting start point of the end 2*a* (2*b*) of the winding 2 at a permanent location (FIGS. 6A and 6B), and thus the flexibility of the ends 2*a* ad 2*b* of the winding 2 is low. Nevertheless, when soldering the twisted portion of the ends 2*a* and 2*b* of the winding 2, a soldering operation is not performed upon one or more turns thereof, to thus retain the above-mentioned flexibility at an appropriate level.

Figure 7:
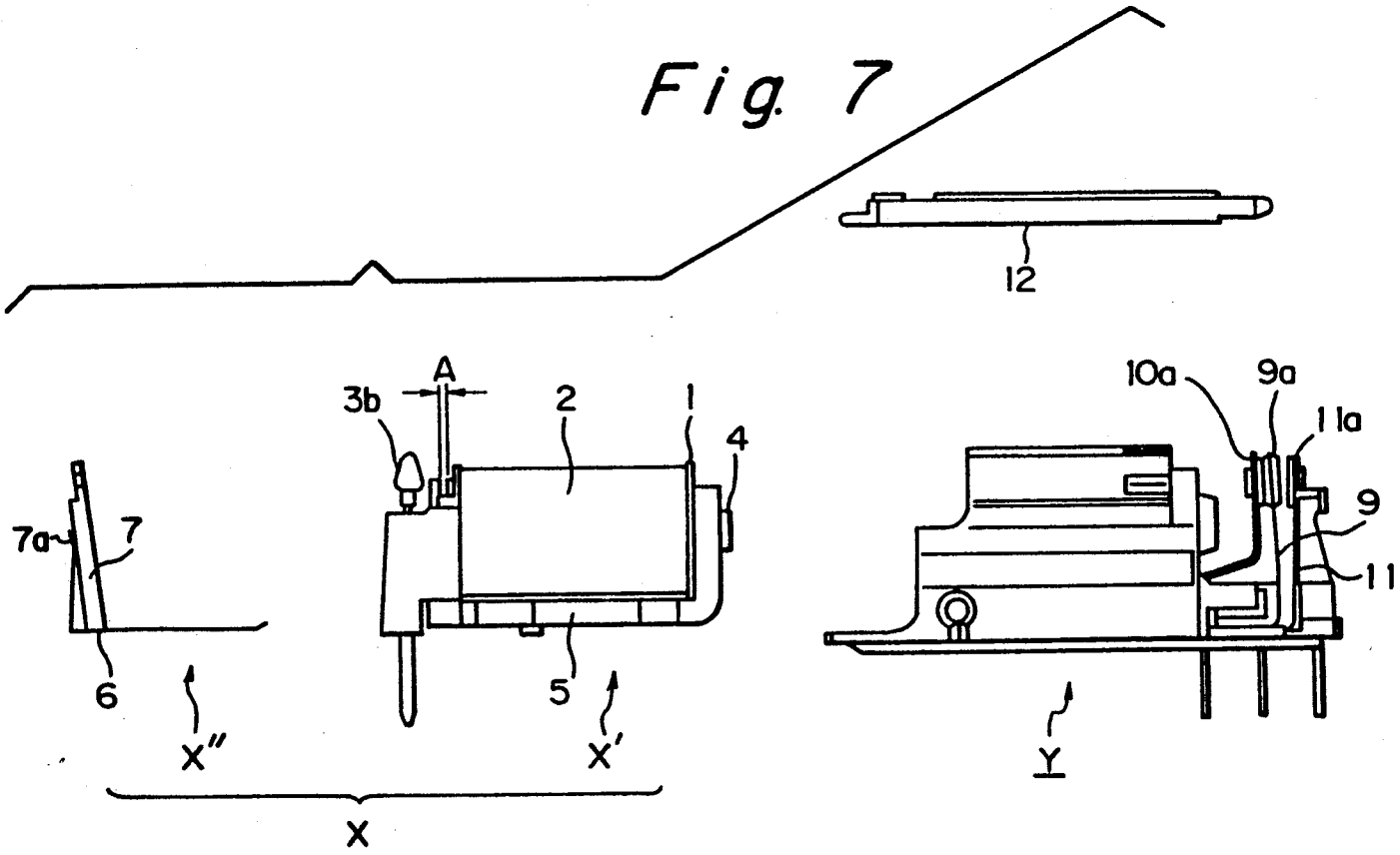
FIG. 7 is a view showing a third assembled state of the relay of FIG. 1.

Next, as shown in FIG. 7, the movable contact spring 9 and the stationary contact springs 10 and 11 are inserted under pressure or by molding into the base block 8, to thus obtain the base block assembly Y. Also, the core 4 is inserted into the bobbin 1 having the winding 2 thereon, and is caulked at the yoke 5, to thus complete a winding block X'. In this case, a definite gap A (see also FIG. 2) is defined between the top of the core 4 and the end of the bobbin 1, and therefore, the bobbin 1 can be moved by the gap A relative to the core 4 and the yoke 5.

Then, the protrusion 7*a* of the armature 7 is inserted into the hole 6*a* of the hinge spring 6, and thereafter, the protrusion 7*a* is caulked to thus complete an armature assembly X".

Further, the protrusions 5*b* of the yoke 5 are fitted into the hinge spring 6, to thus complete the electromagnet assembly X.

Figure 8:
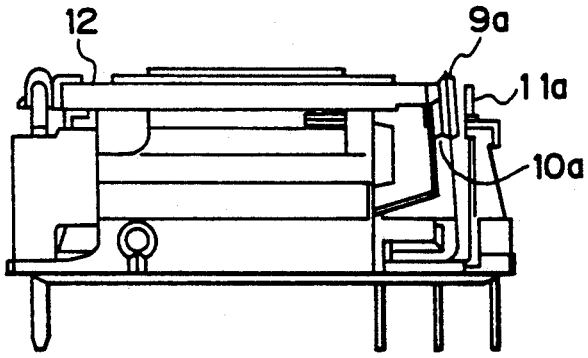
FIG. 8 is a view showing a fourth assembled state of the relay of FIG. 1.

As shown in FIG. 8, to mount the card 12 on the electromagnet assembly X, the fitting portions 12*a* and 12*b* are fitted into the notched portions 7*b* and 7*c* of the armature 7.

Figure 9:
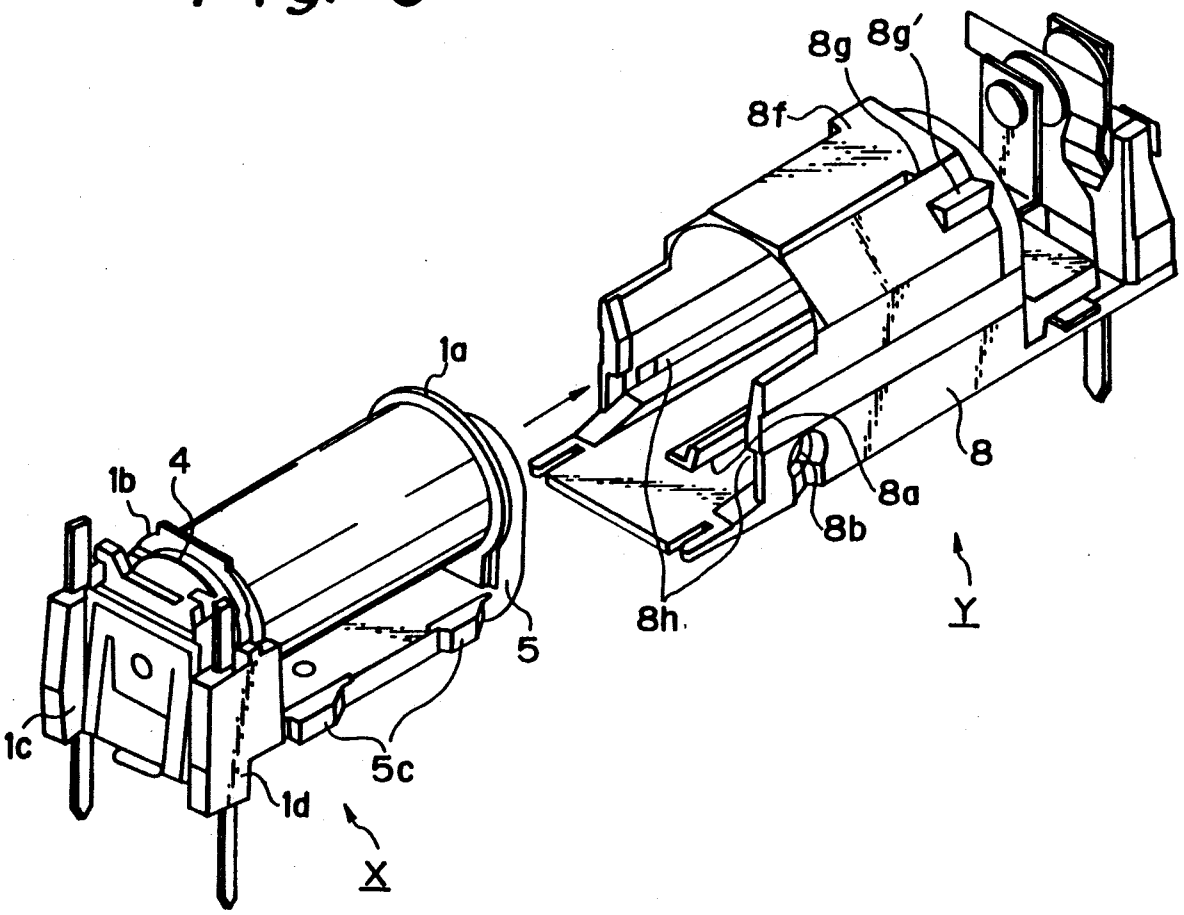
FIG. 9 is a view showing a fifth assembled state of the relay of FIG. 1.
Figure 10:
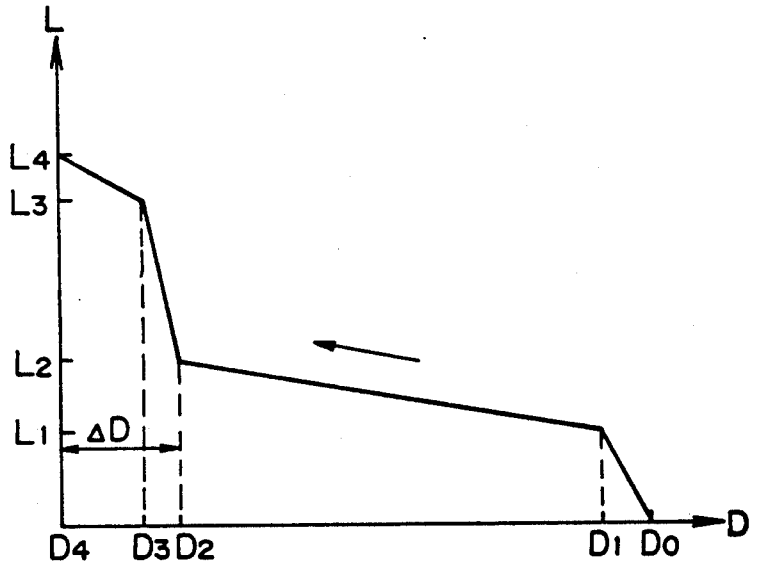
FIG. 10 is a graph showing the assembling steps and operation characteristic of the relay of FIG. 1.

Next, as shown in FIG. 9, the electromagnet assembly X is inserted under pressure into the opening 8*a* of the base block 8 the base block assembly Y. Note, the card 12 is not shown in FIG. 9. As shown in FIG. 9, a state whereby the armature 7 is adhered to the core 4 by the apparatus (not shown) is maintained, and the electromagnet X is gradually inserted under pressure into the base block 8. That is, while the collar 1*a* of the bobbin 1 and four protrusions 5*c* of the yoke 5 are in contact with the protrusion (guide) 8*a* and the protrusions (guides) 8*h* of the base block 8, the electromagnet assembly X is slidably inserted into the base block assembly Y. As a result, when the displacement D of the armature 7 (which also corresponds to the displacement of the electromagnet X to the base block 8) becomes a value $D_0$ as shown in FIG. 10, the protrusions 12*c* and 12*d* of the card 12 are in contact with the movable contact spring 9. When the electromagnet assembly X is further inserted under pressure into the base block 8, the movable contact spring 9 is moved by the protrusions 12*c* and 12*d* along the insertion direction of the electromagnet assembly X. As a result, the displacement D of the armature 7 is increased to $D_1$, and therefore, the load L of the movable contact spring 9 is increased to $L_1$. In this state, when the electromagnet assembly X is further inserted into the base block 8, the displacement D of the armature 7 is gradually increased, and therefore, the load L of the movable contact spring 9 is also gradually increased. Then, when the movable contact spring 9 comes into contact with the stationary contact spring 11, the displacement D of the armature 7 and the load L of the movable contact spring 9 are $D_2$ and $L_2$, respectively, in FIG. 10. At this time, the inserting operation of the electromagnet assembly X is temporarily stopped, and thereafter, the electromagnet assembly X is again inserted into the base block 8 by a definite displacement $\Delta D$ with reference to the displacement $D_2$, and as a result, the displacement $D_4$ of the armature 7 is fixed. In this case, although the electromagnet assembly X is adhered to the base block 8, the protrusions 5*c* of the yoke 5 are caulked at the side holes 8*b* of the base block 8, or are adhered thereto by an adhesive, to thus increase the contact force between the electromagnet assembly X and the base block 8.

Then, the box 13 is mounted on the upper side of the assembled relay of FIG. 9, and the assembly operation is completed.

The operation of tho assembled relay is also explained with reference to FIG. 10.

A state (D, L)=($D_0$, 0) corresponds to a state whereby the armature 7 is not operated, i.e., the core 4 is not energized. In this state, the movable contact 9*a* is in contact with the stationary contact 10*a*. On the other hand, a state (D, L)=($D_4$, $L_4$) corresponds to a state whereby the armature 7 is operated, i.e., the core 4 is energized. In this state, the movable contact 9*a* is in contact with the stationary contact 11*a*.

When a current is supplied to the winding 2, (D, L) is moved from ($D_0$, 0) to ($D_4$, $L_4$). In more detail, when the armature 7 is absorbed to the core 4 to change the displacement D of the armature 7 from $D_0$ to $D_1$, the movable contact spring 9*a* is separated from the stationary contact 10*a*. Thereafter, when the displacement D of the armature 7 becomes $D_2$, the movable contact 9*a* is in contact with the stationary contact 11*a*. As a result, the movable contact spring 9 counteracts the spring pressure of the stationary contact spring 11, and therefore, the displacement D of the armature 7 is changed from $D_2$ to $D_3$, to rapidly increase the load L of the armature 7 from $L_2$to $L_3$. In this state (D, L)=($D_3$, $L_3$), the stationary contact spring 11 is separated from the stopper 8*c* of the base block 8, and the movable contact 9*a* further pushed against the stationary contact 11*a*, to obtain a final state (D, L)=($D_4$, $L_4$). In this final state, the armature 7 is in full contact with the core 4, and the displacement D of the armature 7, i.e., the displacement of the movable contact 9*a* is stopped.

In FIG. 10, the displacement ΔD is called a contact follow which defines a transition from a point at which the movable contact 9*a* comes into contact with the stationary contact 11*a* to a point at which the armature 7 comes into close contact with the core 4. This contact follow amount ΔD guarantees a contact between the contacts 9*a* and 11*a* even when these contacts are abraded. Note that the load L of the armature 7 is greatest when the displacement D of the armature 7 is between $D_2$ and $D_4$.

As explained above, according to the present invention, since a relative position of the electromagnet assembly to the base block assembly can be adjusted, the contact follow amount ΔD can be ensured by absorbing the fluctuation of each element during an assembling operation, to the minimize the load on the armature. Therefore, the absorption force of the core can be made smaller, to thus reduce the size of the electromagnet, i.e., reduce the size of the electromagnetic relay. Also, the reduction in the size of the electromagnet reduces the power dissipated in the electromagnetic relay.

We claim:

1. An electromagnetic relay comprising:

an electromagnet assembly (X) having a core (4);

a bobbin (1) for inserting said core thereinto;

a yoke (5) fixed to an end of said core;

a hinge spring (6);

an armature (7) coupled via said hinge spring to said yoke and coupled to the other end of said core; and a base block assembly (Y) having a base block (8) and a contact spring assembly (9, 10, 11) including a movable contact (9a) and a stationary contact (10*a*, 11*a*) adhered to said base block, wherein an adjustment of said armature to said contact spring assembly is carried out prior to fixing an adjustment of a position of said electromagnet assembly relative to said base block.

2. A relay as set forth in claim 1, wherein said armature is arranged on a side opposite to said contact spring assembly with respect to said core, and sloped portions (8*d*, 8*e*) are formed on said base block along said winding, said relay further comprising a card (12) having two parallel arms (12*e*, 12*f*) for coupling said movable contact to said armature, said parallel arms being arranged on said sloped portions (8*d*, 8*e*) of said base block.

3. A relay as set forth in claim 2, wherein protrusions (8*f*, 8*f'*, 8*g*, 8*g'*) are provided at said sloped portions of said base block, to thereby define the positions of said parallel arms.

4. An relay as set forth in claim 1, wherein said electromagnet assembly further comprises two winding terminals (3*a*, 3*b*) inserted under pressure into said bobbin, each of said winding terminals comprising a provisional squeeze (31) by which said winding terminals are retained in a provisional state, thereby twisting ends (2*a*, 2*b*) of said winding on said winding terminals, and a permanent squeeze (32) by which said winding terminals are retained in a permanent state.

5. A relay as set forth in claim 4, wherein a distance ($l_1$) between a winding groove (1*e*) of said bobbin and a twisting starting point of the end of said winding at the provisional stat defined by said provisional squeeze of said winding terminal is approximately the same as distance ($l_2$) between the winding groove of said bobbin and a twisting starting point of the end of said winding at the provisional state defined by said permanent squeeze of said winding terminal.

6. A relay as set forth in claim 4, wherein a soldering operation is performed upon said twisted ends of said winding terminals except for one or two turns thereof.

7. A relay as set forth in claim 1, wherein an adjustment of said core (4) to said bobbin (5) is carried out by an adjustment of a position of an end portion of said core (4) relative to an end portion of said bobbin (1).

* * * * *